US008237368B2

(12) United States Patent
Lin et al.

(10) Patent No.: US 8,237,368 B2
(45) Date of Patent: Aug. 7, 2012

(54) DRIVING DEVICE AND ELECTRONIC APPARATUS USING THE SAME

(75) Inventors: Kai-Ping Lin, Miaoli (TW); Chun-Hsin Yang, Miaoli (TW); Wen-Cheng Shih, Miaoli (TW)

(73) Assignee: Fitipower Integrated Technology, Inc., Miaoli County (TW)

( * ) Notice: Subject to any disclaimer, the term of this patent is extended or adjusted under 35 U.S.C. 154(b) by 182 days.

(21) Appl. No.: 12/843,031

(22) Filed: Jul. 25, 2010

(65) Prior Publication Data

US 2011/0057575 A1 Mar. 10, 2011

(30) Foreign Application Priority Data

Sep. 4, 2009 (TW) ..... 98129841 A

(51) Int. Cl.
*H05B 37/00* (2006.01)

(52) U.S. Cl. ..... 315/177; 315/200 R; 315/291

(58) Field of Classification Search ..... 315/177, 315/200 R, 206, 225, 226, 287, 291, 297
See application file for complete search history.

(56) References Cited

U.S. PATENT DOCUMENTS

| | | | | |
|---|---|---|---|---|
| 4,685,120 | A | 8/1987 | Norris et al. | |
| 5,872,429 | A * | 2/1999 | Xia et al. | 315/194 |
| 2009/0195168 | A1 * | 8/2009 | Greenfeld | 315/192 |
| 2010/0026208 | A1 * | 2/2010 | Shteynberg et al. | 315/297 |
| 2011/0285301 | A1 * | 11/2011 | Kuang et al. | 315/200 R |
| 2011/0309759 | A1 * | 12/2011 | Shteynberg et al. | 315/201 |

* cited by examiner

*Primary Examiner* — Don Le
(74) *Attorney, Agent, or Firm* — Altis Law Group, Inc.

(57) ABSTRACT

A driving device includes a dimmer, a rectifying-filtering unit, a rectifying-dividing unit, a control unit, and a voltage transforming unit. The dimmer is used for receiving an alternating current (AC) voltage from a power supply, and generating a primary voltage for controlling the brightness of a luminous element. The rectifying-filtering unit is used for rectifying and filtering the primary voltage to generate a secondary voltage. The rectifying-dividing unit is used for rectifying and dividing the primary voltage to generate a detecting voltage. The control unit is used for receiving the secondary voltage, and generating a pulse voltage whose duty cycle is variable with the detecting voltage. The voltage transforming unit is used for transforming the secondary voltage to a driving voltage for driving the luminous element to emit light according to the pulse voltage. A related electronic apparatus is also provided.

20 Claims, 2 Drawing Sheets

DRIVING DEVICE AND ELECTRONIC APPARATUS USING THE SAME

BACKGROUND

1. Technical Field

The disclosed embodiments relate to electronic apparatus; and particularly to driving devices for light emitting diodes (LEDs) used in the electronic apparatus.

2. Description of Related Art

A triode for alternating current (TRIAC) is widely used in light emitting diode (LED) driving circuits. The TRIAC has an on-state and an off-state. A trigger unit is used for triggering the TRIAC to the on-state or the off-state. When the TRIAC is in the on-state, an alternating current (AC) voltage, is provided to the LED driving circuit, so the LED driving circuit can drive a plurality of LEDs to emit light. When the TRIAC is in the off-state, the AC voltage is not provided to the LED driving circuit, so the LEDs cannot emit light.

However, the frequency of changing from the on-state to the off-state or from the off-state to the on-state is often smaller than 50 Hz, therefore the flicker frequency of light emitted by the LEDs is also smaller than 50 Hz, and users may feel that the LED is flashing and unstable.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout two views.

DETAILED DESCRIPTION

Figure 1:
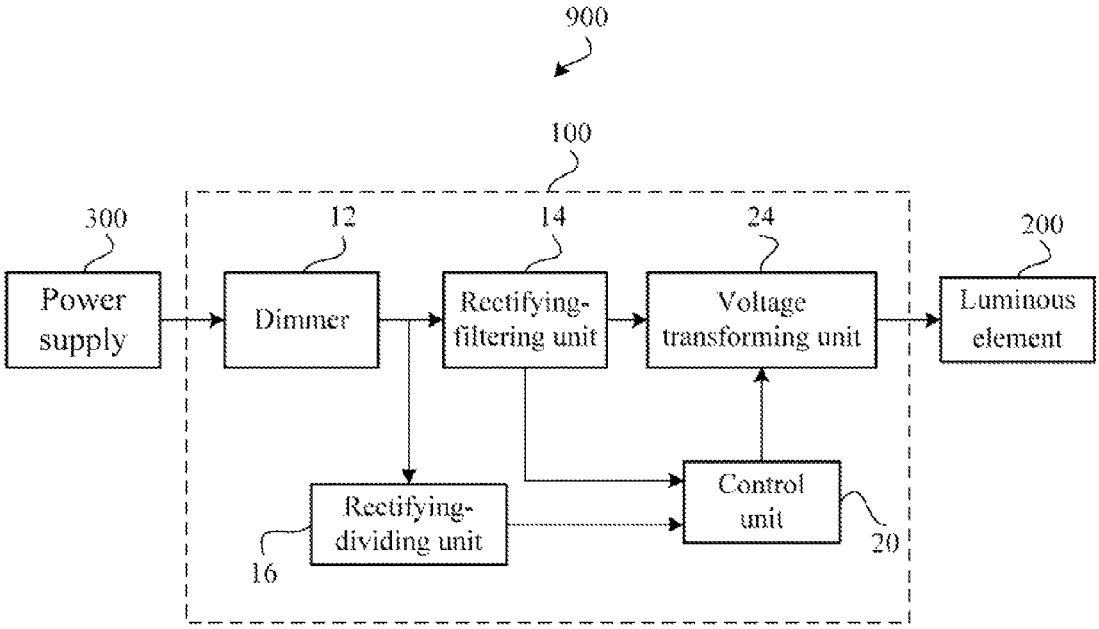
FIG. 1 is a block diagram of an electronic apparatus in accordance with an exemplary embodiment.

Referring to FIG. 1, an electronic apparatus 900 includes a driving device 100 and a luminous element 200. The driving device 100 is used for receiving an alternating current (AC) voltage from a power supply 300, and generating a driving voltage to drive the luminous element 200 to emit light. The driving device 100 includes a dimmer 12, a rectifying-filtering unit 14, a rectifying-dividing unit 16, a control unit 20, and a voltage transforming unit 24.

The dimmer 12 is used for receiving the AC voltage, and generating a primary voltage for controlling the brightness of the luminous element 200. In detail, see FIG. 2, the dimmer 12 includes a triode for alternating current (TRIAC) 120 and a trigger unit 124. The TRIAC 120 includes a base terminal, a first main terminal, and a second main terminal. The base terminal is connected to the trigger unit 124, such as a diode for alternating current (DIAC); the first main terminal is connected to the power supply 300; the second main terminal is connected to the rectifying-filtering unit 14 and the rectifying-dividing unit 16. The TRIAC 120 has an off-state and an on-state. The trigger unit 124 is used for triggering the TRIAC 120 to the off-state or the on-state. When the TRIAC 120 is in the on-state, the AC voltage is respectively provided to the rectifying-filtering unit 14 and the rectifying-dividing unit 16.

When the TRIAC 120 is in the off-state, the AC voltage is not provided to the rectifying-filtering unit 14 and the rectifying-dividing unit 16.

The rectifying-filtering unit 14 is used for rectifying and filtering the primary voltage to generate a secondary voltage.

The rectifying-dividing unit 16 is used for rectifying and dividing the primary voltage to generate a detecting voltage.

The control unit 20 is coupled to the rectifying-filtering unit 14, the rectifying-dividing unit 16, and the voltage transforming unit 24. The control unit 20 is used for receiving the secondary voltage and the detecting voltage, and generating a pulse voltage whose duty cycle is varied with the detecting voltage.

The voltage transforming unit 24 is used for transforming the secondary voltage to the driving voltage according to the pulse voltage. The driving voltage is provided to the luminous element 200 and is used for driving the luminous element 200 to emit light.

Figure 2:
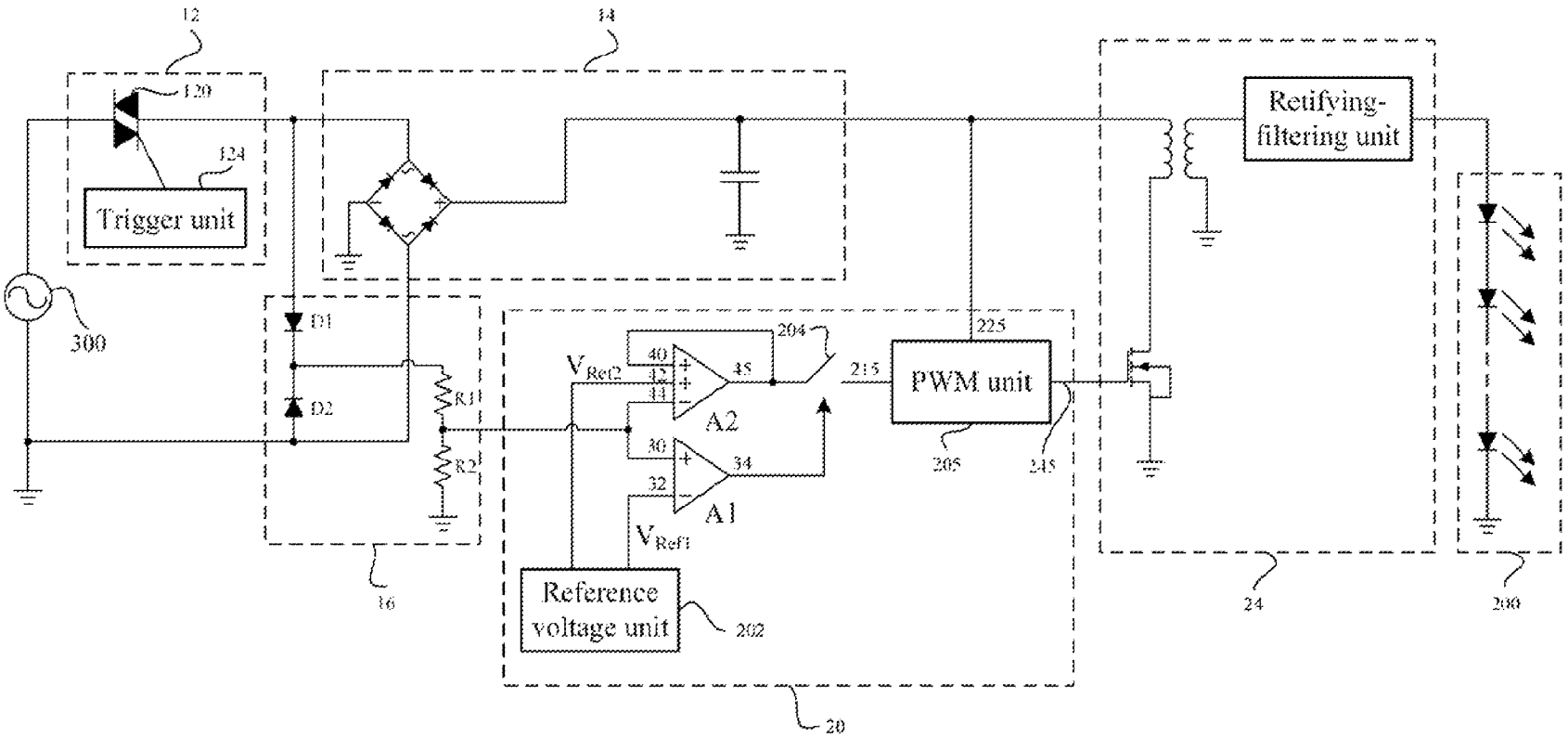
FIG. 2 is a circuit diagram of the electronic apparatus of FIG. 1 in accordance with the exemplary embodiment.

Referring to FIG. 2, the luminous element 200 includes a plurality of LEDs connected in series. The rectifying-dividing unit 16 includes a first diode D1, a second diode D2, a first resistor R1, and a second resistor R2. An anode of the first diode D1 is connected to the second main terminal of the TRIAC 120, a cathode of the first diode D1 is connected to a cathode of the second diode D2, and an anode of the second diode D2 is grounded. One end of the first resistor R1 is connected between the cathode of the first diode D1 and the cathode of the second diode D2, the other end of the first resistor R1 is grounded through the second resistor R2.

The control unit 20 includes a terminal connected between the first resistor R1 and the second resistor R2. The control unit 20 includes a reference voltage unit 202, a first comparison unit A1, a second comparison unit A2, a switch 204, and a pulse width modulation (PWM) unit 205. The switch 204 is connected between the second comparison unit A2 and the PWM unit 205. The reference voltage unit 202 is used for providing a first reference voltage $V_{Ref1}$ and a second reference voltage $V_{Ref2}$. The first comparison unit A1 is used for comparing the detecting voltage with the first reference voltage $V_{Ref1}$, generating a first level signal if the detecting voltage is larger than the first reference voltage $V_{Ref1}$, and generating a second level signal if the detecting voltage is smaller than the first reference voltage $V_{Ref1}$. In this embodiment, the first level signal is a high level signal, and the second level signal is a low level signal.

The second comparison unit A2 is used for comparing the detecting voltage with the second reference voltage $V_{Ref2}$, generating a control voltage if the detecting voltage is smaller than the second reference voltage $V_{Ref2}$, and outputting the detecting voltage if the detecting voltage is larger than the second reference voltage $V_{Ref2}$. The control voltage linearly increases with the detecting voltage. The switch 204 is turned on according to the first level signal and establishes an electrical connection between the second comparison unit A2 and the PWM unit 205. The switch 204 cuts off the electrical connection between the second comparison unit A2 and the PWM unit 205 according to the second level signal. The PWM unit 205 is used for receiving the secondary voltage to be powered on, generating the pulse voltage whose duty cycle is linearly increased with the control voltage when received the control voltage, and generating the pulse voltage whose duty cycle is invariable when received the detecting voltage.

In this embodiment, both of the first comparison unit A1 and the second comparison unit A2 are an operational amplifier. The first operational amplifier A1 includes a first non-inverting input terminal 30, a first inverting input terminal 32, and a first output terminal 34. The second operational amplifier A2 includes a second non-inverting input terminal 40, a third non-inverting input terminal 42, a second inverting input terminal 44, and a second output terminal 45. The first non-inverting input terminal 30 is connected to the second inverting input terminal 44. The first inverting input terminal 32 is used for receiving the first reference voltage $V_{Ref1}$. The first non-inverting input terminal 30 and the second inverting input terminal 44 are connected between the first resistor R1 and the second resistor R2. The second non-inverting input terminal 40 is connected to the second output terminal 45, and the third non-inverting input terminal 42 is used for receiving the second reference voltage $V_{Ref2}$. The switch 204 is connected between the second output terminal 45 and the PWM unit 205, the first output terminal 34 is used for outputting a control signal to turn on/off the switch 204. The PWM unit 205 includes a control terminal 215, a first terminal 225, and a second terminal 245. The control terminal 215 is connected to the second output terminal 45 through the switch 204. The first terminal 225 is connected to the rectifying-filtering unit 14. The second terminal 245 is connected to the voltage transforming unit 24.

The voltage transforming unit 24 is used for transforming the secondary voltage to the driving voltage when receiving the pulse voltage whose duty cycle is invariable, and the driving voltage is invariable. Therefore, the brightness of the luminous element 200 is stable.

The voltage transforming unit 24 is used for transforming the secondary voltage to the driving voltage when receiving the pulse voltage whose duty cycle is linearly increased with the control voltage, and the driving voltage is also linearly increased. Therefore, brightness of the luminous element 200 is increased. Because frequency of the PWM unit 205 is 20 KHz~100 KHz, therefore frequency of the pulse voltage generated by the PWM unit 205 is much higher than 50 Hz, the flicker frequency of light emitted by the luminous element 200 is also higher than 50 Hz, and the luminous element 200 appears stable.

Further alternative embodiments will become apparent to those skilled in the art without departing from the spirit and scope of what is claimed. Accordingly, the present invention should be deemed not to be limited to the above detailed description, but rather only by the claims that follow and equivalents thereof.

What is claimed is:

1. A driving device used for receiving an alternating current (AC) voltage from a power supply, and generating a driving voltage to drive a luminous element to emit light, the driving device comprising:

a dimmer for receiving the AC voltage, and generating a primary voltage for controlling the brightness of the luminous element;

a rectifying-filtering unit for rectifying and filtering the primary voltage to generate a secondary voltage;

a rectifying-dividing unit for rectifying and dividing the primary voltage to generate a detecting voltage;

a control unit for receiving the secondary voltage, and generating a pulse voltage whose duty cycle is variable with the detecting voltage; and a voltage transforming unit for transforming the secondary voltage to the driving voltage according to the pulse voltage.

2. The driving device of claim 1, wherein the control unit comprises a reference voltage unit for providing a first reference voltage and a second reference voltage, a first comparison unit, a second comparison unit, a pulse width modulation (PWM) unit, and a switch connected between the second comparison unit and the PWM unit, the first comparison unit is used for comparing the detecting voltage with the first reference voltage, and generating a first level signal if the detecting voltage is larger than the first reference voltage, the second comparison unit is used for comparing the detecting voltage with the second reference voltage, and generating a control voltage linearly increasing with the detecting voltage if the detecting voltage is smaller than the second reference voltage, the switch is turned on according to the first level signal and establishes an electrical connection between the second comparison unit and the PWM unit, the PWM unit is used for receiving the secondary voltage to be powered on, and generating the pulse voltage whose duty cycle is linearly increased with the control voltage when receiving the control voltage.

3. The driving device of claim 2, wherein the second comparison unit outputs the detecting voltage if the detecting voltage is larger than the second reference voltage, the PWM unit generates the pulse voltage whose duty cycle is invariable when receiving the detecting voltage.

4. The driving device of claim 2, wherein the first comparison unit generates a second level signal if the detecting voltage is smaller than the first reference voltage, the switch cuts off the electrical connection between the second comparison unit and the PWM unit according to the second level signal.

5. The driving device of claim 2, wherein the first comparison unit is a first operational amplifier, the second comparison unit is a second operational amplifier, the first operational amplifier comprises a first non-inverting input terminal, a first inverting input terminal, and a first output terminal, the second operational amplifier comprises a second non-inverting input terminal, a third non-inverting input terminal, a second inverting input terminal, and a second output terminal, the first non-inverting input terminal is connected to the second inverting input terminal, the first inverting input terminal is used for receiving the first reference voltage, the first non-inverting input terminal and the second inverting input terminal are connected between the first resistor and the second resistor, the second non-inverting input terminal is connected to the second output terminal, the third non-inverting input terminal is used for receiving the second reference voltage, the switch is connected between the second output terminal and the PWM unit, the first output terminal is used for outputting a control signal to turn on/off the switch, the PWM unit comprises a control terminal, a first terminal, and a second terminal, the control terminal is connected to the second output terminal through the switch, the first terminal is connected to the rectifying-filtering unit, the second terminal is connected to the voltage transforming unit.

6. The driving device of claim 2, wherein the first reference voltage is smaller than the second reference voltage.

7. The driving device of claim 1, wherein the dimmer comprises a triode for alternating current (TRIAC) and a trigger unit, the TRIAC have an off-state and an on-state, the trigger unit is used for triggering the TRIAC to the off-state or the on-state, when the TRIAC is in the on-state, the AC voltage is provided to the rectifying-filtering unit and the rectifying-dividing unit respectively, when the TRIAC is in the off-state, the AC voltage is not provided to the rectifying-filtering unit and the rectifying-dividing unit.

8. The driving device of claim 7, wherein the TRIAC comprises a base terminal, a first main terminal, and a second main terminal, the base terminal is connected to the trigger unit, the first main terminal is connected to the power supply, the second main terminal is connected to the rectifying-filtering unit and the rectifying-dividing unit.

9. The driving device of claim 1, wherein the rectifying-dividing unit comprises a first diode, a second diode, a first resistor, and a second resistor, an anode of the first diode is connected to the dimmer, a cathode of the first diode is connected to a cathode of the second diode, an anode of the second diode is grounded, one end of the first resistor is connected between the cathode of the first diode and the cathode of the second diode, the other end of the first resistor is grounded through the second resistor, the control unit comprises a terminal connected between the first resistor and the second resistor.

10. A driving device used for receiving an alternating current (AC) voltage from a power supply, and generating a driving voltage to drive a luminous element to emit light, the driving device comprising:

a dimmer for receiving the AC voltage, and generating a primary voltage for controlling the brightness of the luminous element;

a rectifying-filtering unit for rectifying and filtering the primary voltage to generate a secondary voltage;

a rectifying-dividing unit for rectifying and dividing the primary voltage to generate a detecting voltage;

a control unit for comparing the detecting voltage with a first reference voltage and a second reference voltage, and generating a pulse voltage whose duty cycle is variable if the detecting voltage is larger than a first reference voltage and smaller than a second reference voltage; and a voltage transforming unit for transforming the secondary voltage to the driving voltage according to the pulse voltage.

11. The driving device of claim 10, wherein control unit for generating the pulse voltage whose duty cycle is invariable if the detecting voltage is larger than the second reference voltage, and the driving voltage is invariable.

12. The driving device of claim 10, wherein the control unit comprises a reference voltage unit for providing the first reference voltage and the second reference voltage, a first comparison unit, a second comparison unit, a pulse width modulation (PWM) unit, and a switch connected between the second comparison unit and the PWM unit, the first comparison unit is used for comparing the detecting voltage with the first reference voltage, and generating a first level signal if the detecting voltage is larger than the first reference voltage, the second comparison unit is used for comparing the detecting voltage with the second reference voltage, and generating a control voltage linearly increasing with the detecting voltage if the detecting voltage is smaller than the second reference voltage, the switch is turned on according to the first level signal and establishes an electrical connection between the second comparison unit and the PWM unit, the PWM unit is used for receiving the secondary voltage to be powered on, and generating the pulse voltage whose duty cycle is linearly increased with the control voltage when receiving the control voltage.

13. The driving device of claim 12, wherein the second comparison unit outputs the detecting voltage if the detecting voltage is larger than the second reference voltage, the PWM unit generates the pulse voltage whose duty cycle is invariable when receiving the detecting voltage.

14. The driving device of claim 12, wherein the first comparison unit generates a second level signal if the detecting voltage is smaller than the first reference voltage, the switch cuts off the electrical connection between the second comparison unit and the PWM unit according to the second level signal.

15. The driving device of claim 12, wherein the first comparison unit is a first operational amplifier, the second comparison unit is a second operational amplifier, the first operational amplifier comprises a first non-inverting input terminal, a first inverting input terminal, and a first output terminal, the second operational amplifier comprises a second non-inverting input terminal, a third non-inverting input terminal, a second inverting input terminal, and a second output terminal, the first non-inverting input terminal is connected to the second inverting input terminal, the first inverting input terminal is used for receiving the first reference voltage, the first non-inverting input terminal and the second inverting input terminal are connected between the first resistor and the second resistor, the second non-inverting input terminal is connected to the second output terminal, the third non-inverting input terminal is used for receiving the second reference voltage, the switch is connected between the second output terminal and the PWM unit, the first output terminal is used for outputting a control signal to turn on/off the switch, the PWM unit comprises a control terminal, a first terminal, and a second terminal, the control terminal is connected to the second output terminal through the switch, the first terminal is connected to the rectifying-filtering unit, the second terminal is connected to the voltage transforming unit.

16. An electronic apparatus comprising:

a luminous element; and an driving device for receiving an alternating current (AC) voltage from a power supply and generating a driving voltage to drive the luminous element to emit light, the driving device comprising:

a dimmer for receiving the AC voltage, and generating a primary voltage for controlling the brightness of the luminous element;

a rectifying-filtering unit for rectifying and filtering the primary voltage to generate a secondary voltage;

a rectifying-dividing unit for rectifying and dividing the primary voltage to generate a detecting voltage;

a control unit for receiving the secondary voltage, and generating a pulse voltage whose duty cycle is variable with the detecting voltage; and a voltage transforming unit for transforming the secondary voltage to the driving voltage according to the pulse voltage.

17. The electronic apparatus of claim 16, wherein the control unit comprises a reference voltage unit for providing a first reference voltage and a second reference voltage, a first comparison unit, a second comparison unit, a pulse width modulation (PWM) unit, and a switch connected between the second comparison unit and the PWM unit, the first comparison unit is used for comparing the detecting voltage with the first reference voltage, and generating a first level signal if the detecting voltage is larger than the first reference voltage, the second comparison unit is used for comparing the detecting voltage with the second reference voltage, and generating a control voltage linearly increasing with the detecting voltage if the detecting voltage is smaller than the second reference voltage, the switch is turned on according to the first level signal and establishes an electrical connection between the second comparison unit and the PWM unit, the PWM unit is used for receiving the secondary voltage to be powered on, and generating the pulse voltage whose duty cycle is linearly increased with the control voltage when receiving the control voltage.

18. The electronic apparatus of claim 17, wherein the second comparison unit outputs the detecting voltage if the detecting voltage is larger than the second reference voltage, the PWM unit generates the pulse voltage whose duty cycle is invariable when receiving the detecting voltage.

19. The electronic apparatus of claim 17, wherein the first comparison unit generates a second level signal if the detecting voltage is smaller than the first reference voltage, the switch cuts off the electrical connection between the second comparison unit and the PWM unit according to the second level signal.

20. The electronic apparatus of claim 17, wherein the first comparison unit is a first operational amplifier, the second comparison unit is a second operational amplifier, the first operational amplifier comprises a first non-inverting input terminal, a first inverting input terminal, and a first output terminal, the second operational amplifier comprises a second non-inverting input terminal, a third non-inverting input terminal, a second inverting input terminal, and a second output terminal, the first non-inverting input terminal is connected to the second inverting input terminal, the first inverting input terminal is used for receiving the first reference voltage, the first non-inverting input terminal and the second inverting input terminal are connected between the first resistor and the second resistor, the second non-inverting input terminal is connected to the second output terminal, the third non-inverting input terminal is used for receiving the second reference voltage, the switch is connected between the second output terminal and the PWM unit, the first output terminal is used for outputting a control signal to turn on/off the switch, the PWM unit comprises a control terminal, a first terminal, and a second terminal, the control terminal is connected to the second output terminal through the switch, the first terminal is connected to the rectifying-filtering unit, the second terminal is connected to the voltage transforming unit.

* * * * *